US006457386B1

(12) United States Patent
Chiang

(10) Patent No.: US 6,457,386 B1
(45) Date of Patent: Oct. 1, 2002

(54) RATCHET WRENCH

(76) Inventor: Shui-Lai Chiang, 58, Ma Yuan West St., Taichung (TW)

( * ) Notice: Subject to any disclaimer, the term of this patent is extended or adjusted under 35 U.S.C. 154(b) by 0 days.

(21) Appl. No.: 10/047,360

(22) Filed: Jan. 11, 2002

(51) Int. Cl.[7] ..... B25B 13/46
(52) U.S. Cl. ..... 81/62; 81/57.29
(58) Field of Search ..... 81/62, 63.1, 58.4, 81/57.29, 57.26; 192/43, 43.1

(56) References Cited

U.S. PATENT DOCUMENTS 5,058,463 A * 10/1991 Wannop ..... 81/57.26
6,070,499 A * 6/2000 Wisbey ..... 81/57.29
6,311,584 B1 * 11/2001 Chu ..... 81/57.29

* cited by examiner

*Primary Examiner*—James G. Smith
*Assistant Examiner*—Hadi Shakeri

(57) ABSTRACT

A ratchet wrench has a main body, a drive shaft, a first annular gear, a second annular gear, a drive member, a pair of first pawls, a lpair of second pawls, a rotating wheel, a control member, and a coiled spring. The main body has a through hole to receive the drive shaft, a groove to receive the drive member, and a plurality of inner teeth. The control member has a pillar and a press disk. The drive member has a through aperture and a chamber to receive the first pawls and the second pawls. The first annular gear encloses one of the first pawls and one of the second pawls. The second annular gear encloses the other of the first pawls and the other of the second pawls. The pillar is inserted through the coiled spring, the rotating wheel, and the drive member.

2 Claims, 9 Drawing Sheets

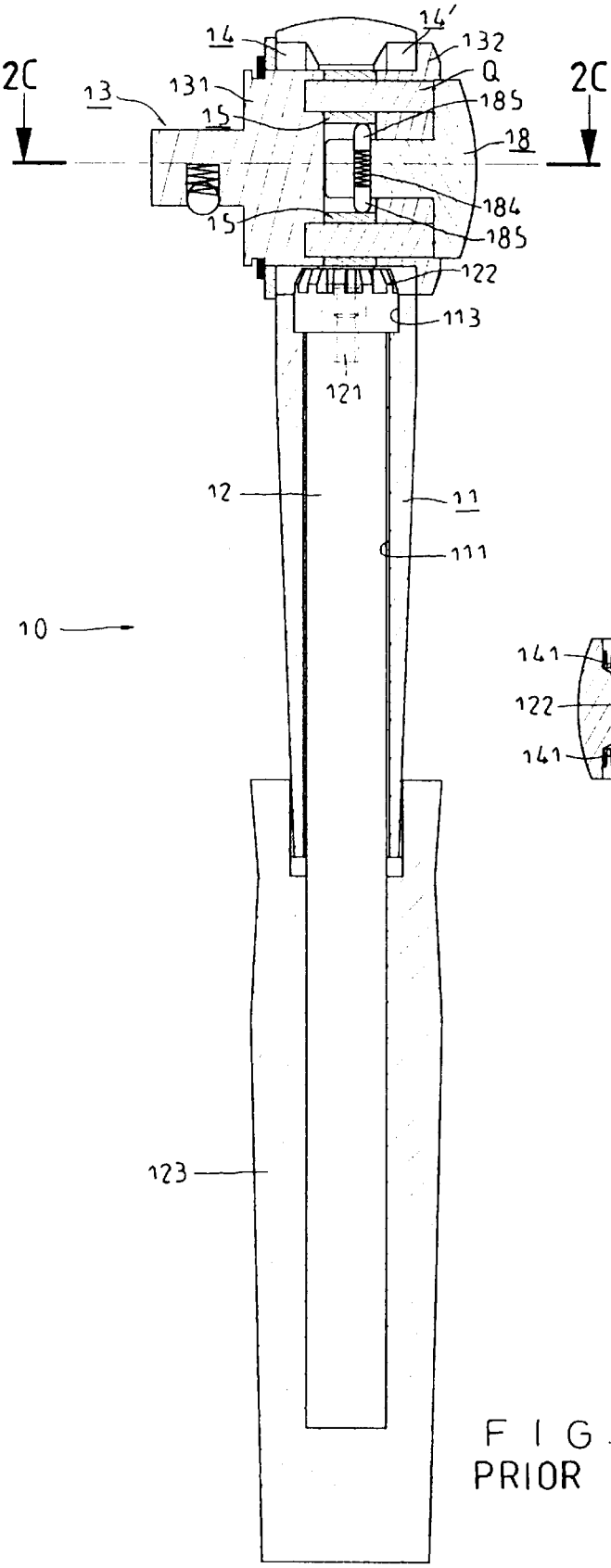
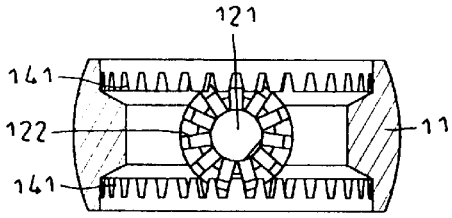
FIG. 2A
PRIOR ART
FIG. 2
PRIOR ART

RATCHET WRENCH

BACKGROUND OF THE INVENTION

The present invention relates to a ratchet wrench. More particularly, the present invention relates to a ratchet wrench which is easily assembled.

Referring to FIGS. 1 to 3, a conventional ratchet wrench 10 has a main body 11, a drive shaft 12, a handle 123, a first annular gear 14, a second annular gear 14', a drive member 13 having a first seat 131 and a second seat 132 engaging with the first seat 131, a pair of pawls 15, and a selector switch 18. A handle 123 receives a portion of the drive shaft 12. The drive shaft 12 has an inner threaded hole 121. A bevel drive ring gear 122 is disposed on the drive shaft 12. The main body 11 has a through hole 111 to receive the drive shaft 12, a groove 112 to receive the drive member 13, the first annular gear 14 and the second annular gear 14', an inner opening 113 to receive the bevel drive ring gear 122, a plurality of inner teeth 114, and the through hole 111 communicating with the groove 112. The drive member 13 is disposed between the first annular gear 14 and the second annular gear 14'. The first annular gear 14 has a plurality of one-sided serrations 141. The second annular gear 14' has a plurality of one-sided teeth 141'. Each of the pawls 15 has a curved notch 153, a pivot hole 151, and a plurality of outer teeth 152. The first seat 131 has two round apertures 133. The second seat 132 has a center hole 135 and two circular apertures 134. The selector switch 18 has a post 181 having a through aperture 182 and an oblong recess 183. The post 181 passes through the center hole 135 of the second seat 132. Two pins Q pass through the circular apertures 134 of the second seat 132, two pawls 15, and the round apertures 133 of the first seat 131. A spring 184 and two positioning balls 185 are inserted in the through aperture 182 of the selector switch 18. The spring 184 is disposed between the positioning balls 185. Two elastic plates 16 are disposed between the first seat 131 and the second seat 132. Each of the elastic plates 16 has a pivot end 161, and a recessed end 162 to receive a rolling member 17. The outer teeth 152 of each pawl 15 engages with the inner teeth 114 of the main body 11. The bevel drive ring gear 122 engages with the one-sided serrations 114 of the first annular gear 14 and the one-sided teeth 141' of the second annular gear 14'. Each ball 185 is inserted in the corresponding curved notch 153 of each pawl 15. The rolling member 17 clicks an inner periphery of the first annular gear 14 and an inner periphery of the second annular gear 14'. However, a rolling friction will occur, so the rolling member 17 cannot click the inner periphery of the first annular gear 14 and the inner periphery of the second annular gear 14' efficiently. Furthermore, it is difficult to form the inner opening 113 of the main body 11 and to fasten the bevel drive ring gear 122 and the drive shaft 12 together with a screw P because of a narrow spacing of the inner opening 113 of the main body 11. Referring to FIGS. 4 and 5, U.S. Pat. No. 6,070,499 has provided another ratchet wrench. The ratchet wrench has a hollow handle 31, a knurled sleeve 34 receiving a rear portion of the hollow handle 31, a shaft 32 inserted in the hollow handle 31, a drive housing 310 disposed on an end of the hollow handle 31, the drive housing 310 having a groove 312 and a plurality of inner serrations 313, a bevel drive ring gear 37 and a drive member 33 inserted in the groove 312 of the drive housing 310, the bevel drive ring gear 37 having a plurality of outer teeth 372 engaging with the inner serrations 313 of the drive housing 310 and a plurality of inner teeth 371, a pair of pawls 35, and a selector switch 36. The selector switch 36 has a finger grip 361 and a spindle 362. The drive member 33 has a cylindrical axial aperture 332, and two slots 331 to receive the pawls 35. Each pawl 35 has a plurality of outer serrations 351. The bevel drive ring gear 37 engages with one of the pawls 35. The spindle 362 is inserted in the cylindrical axial aperture 332 of the drive member 33. A pin Q fastens the drive member 33 and the pawls 35 together. The spindle 362 has two circular holes 363, and each of the circular holes 363 receiving a spring S and a bearing pin 38. The shaft 32 has a bevel pinion gear 321. A screw P fastens the knurled sleeve 34 and the shaft 32 together. The hollow handle 31 has an undercut 311. The bevel pinion gear 321 engages with the outer teeth 372 of the bevel drive ring gear 37. The bevel drive ring gear 37 engages with one of the pawls 35 only, so the drive member 33 can be driven in one direction only.

SUMMARY OF THE INVENTION

An object of the present invention is to provide a ratchet wrench which is easily assembled.

Another object of the present invention is to provide a ratchet wrench which has dual means of producing rotation of a drive member efficiently.

Accordingly, a ratchet wrench comprises a main body, a drive shaft, a handle, a first annular gear, a second annular gear, a drive member, a pair of first pawls, a pair of second pawls, a rotating wheel, a control member, a plurality of balls, a plurality of compression springs, and a coiled spring. The main body has a through hole to receive the drive shaft, a pair of pivot holes, a groove to receive the drive member, a plurality of inner teeth, and the through hole communicating with the groove. The drive member has a through aperture and a chamber. The handle has a blind hole to receive the drive shaft. The first annular gear has a plurality of inner periphery serrations and a plurality of one-sided serrations. The second annular gear has a plurality of inner periphery teeth and a plurality of one-sided teeth. Each of the first pawls has a plurality of positioning recesses and a plurality of outer teeth. Each of the second pawls has a plurality of periphery serrations and a plurality of one-sided serrations. The rotating wheel has an oblong center hole. The control member has a pillar and a press disk disposed on the pillar. The pillar has a plurality of circular holes. Each of the circular holes of the pillar receives the corresponding compression spring and the corresponding ball. A pair of studs pass through the pivot holes of the main body and an annular recess of the drive shaft. The chamber of the drive member receives the first pawls and the second pawls. The first annular gear encloses one of the first pawls and one of the second pawls. The second annular gear encloses the other of the first pawls and the other of the second pawls. The pillar is inserted through the coiled spring, the oblong center hole of the rotating wheel, and the through aperture of the drive member. The coiled spring is disposed between the press disk and the rotating wheel. Each of the balls engages with one of the first pawls and the second pawls.

BRIEF DESCRIPTION OF THE DRAWINGS

FIG. 2 is a sectional assembly view of a ratchet wrench of a prior art;

FIG. 2A is a sectional view taken along line 2C—2C in FIG. 2;

DETAILED DESCRIPTION OF THE INVENTION

Figure 1:
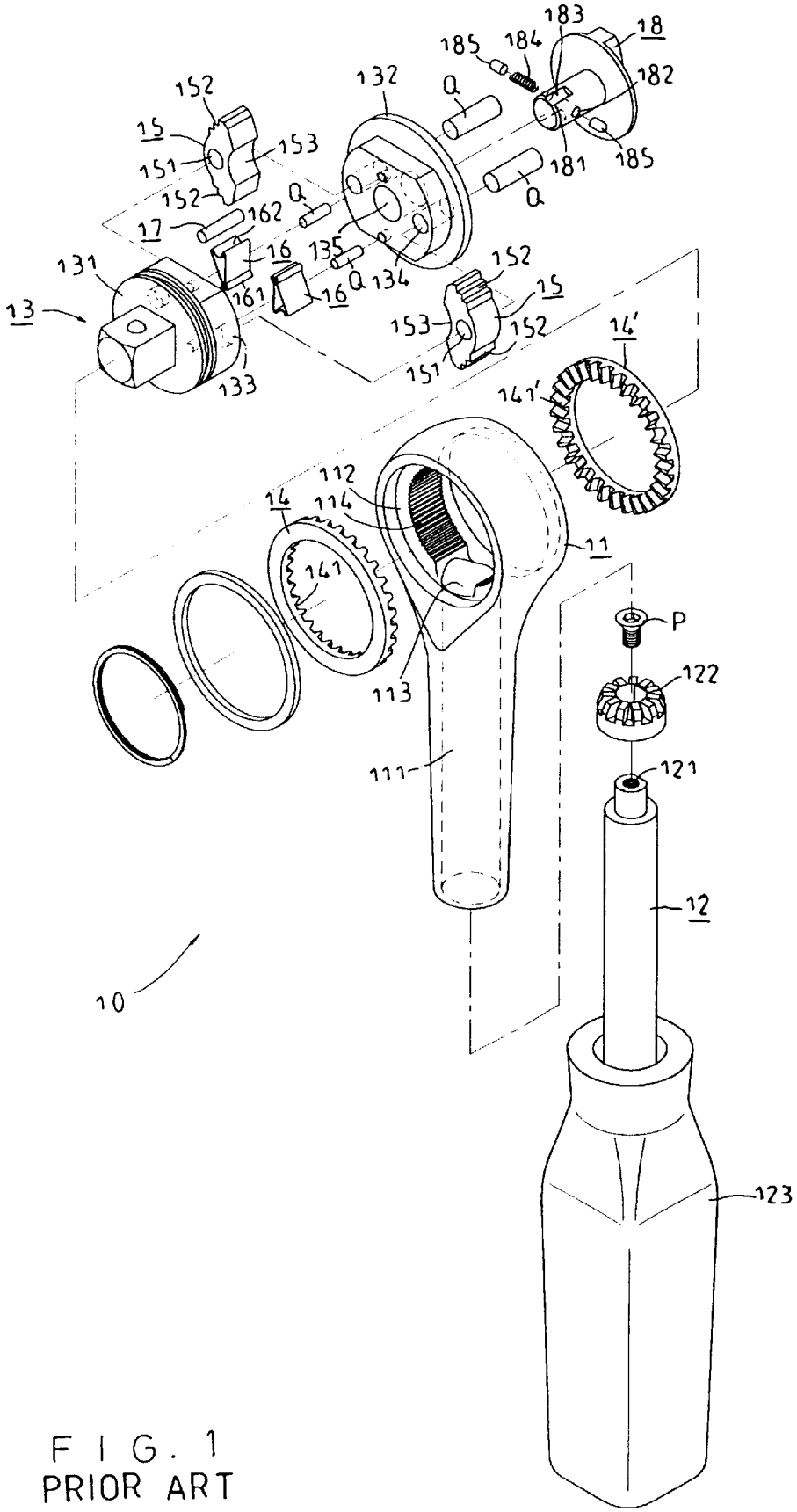
FIG. 1 PRIOR ART
FIG. 1 is a perspective exploded view of a ratchet wrench of a prior art.
Figure 3:
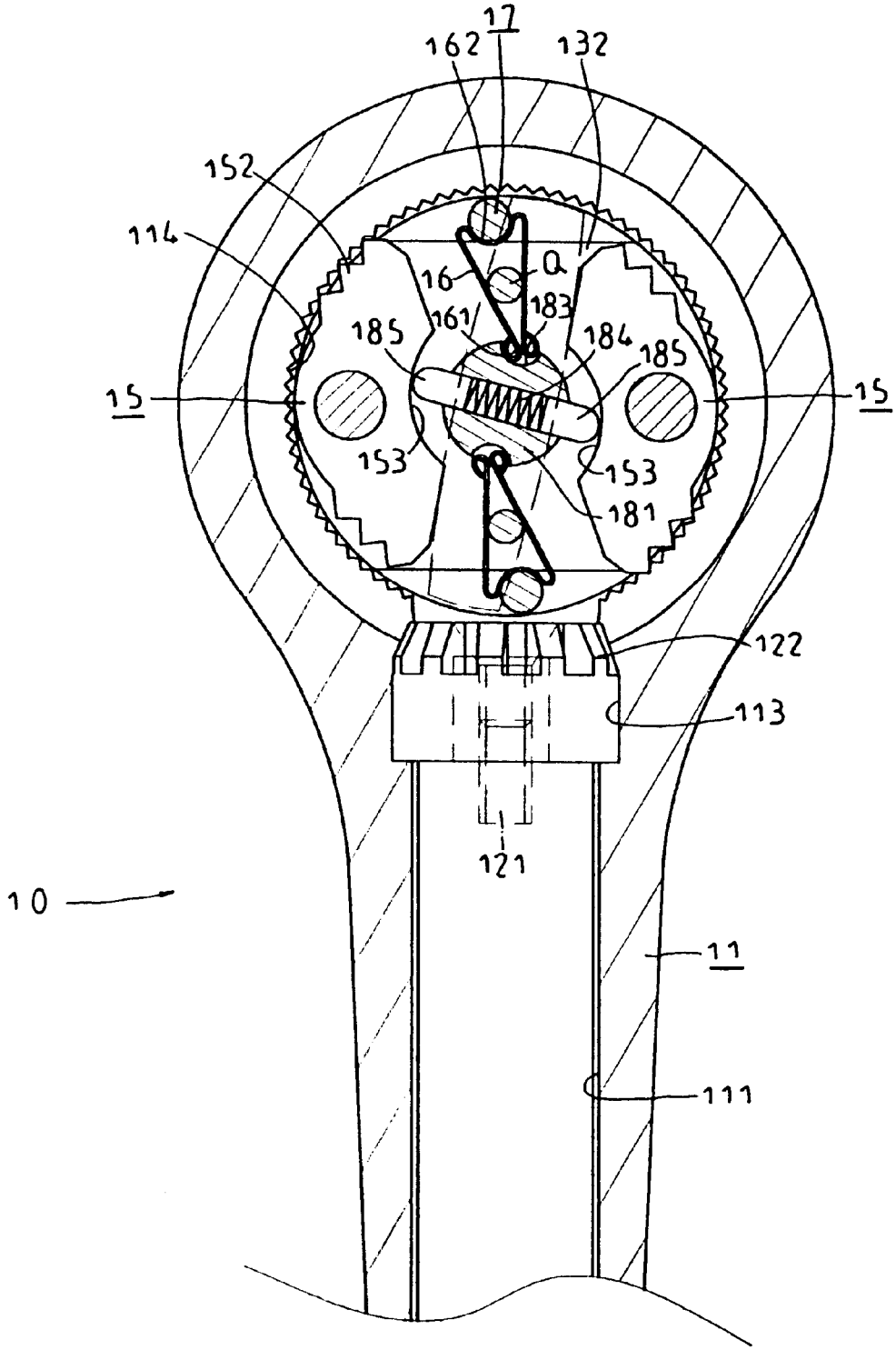
F I G. 3 PRIOR ART
FIG. 3 is a sectional schematic view illustrating an operation of a ratchet wrench of a prior art.
Figure 4:
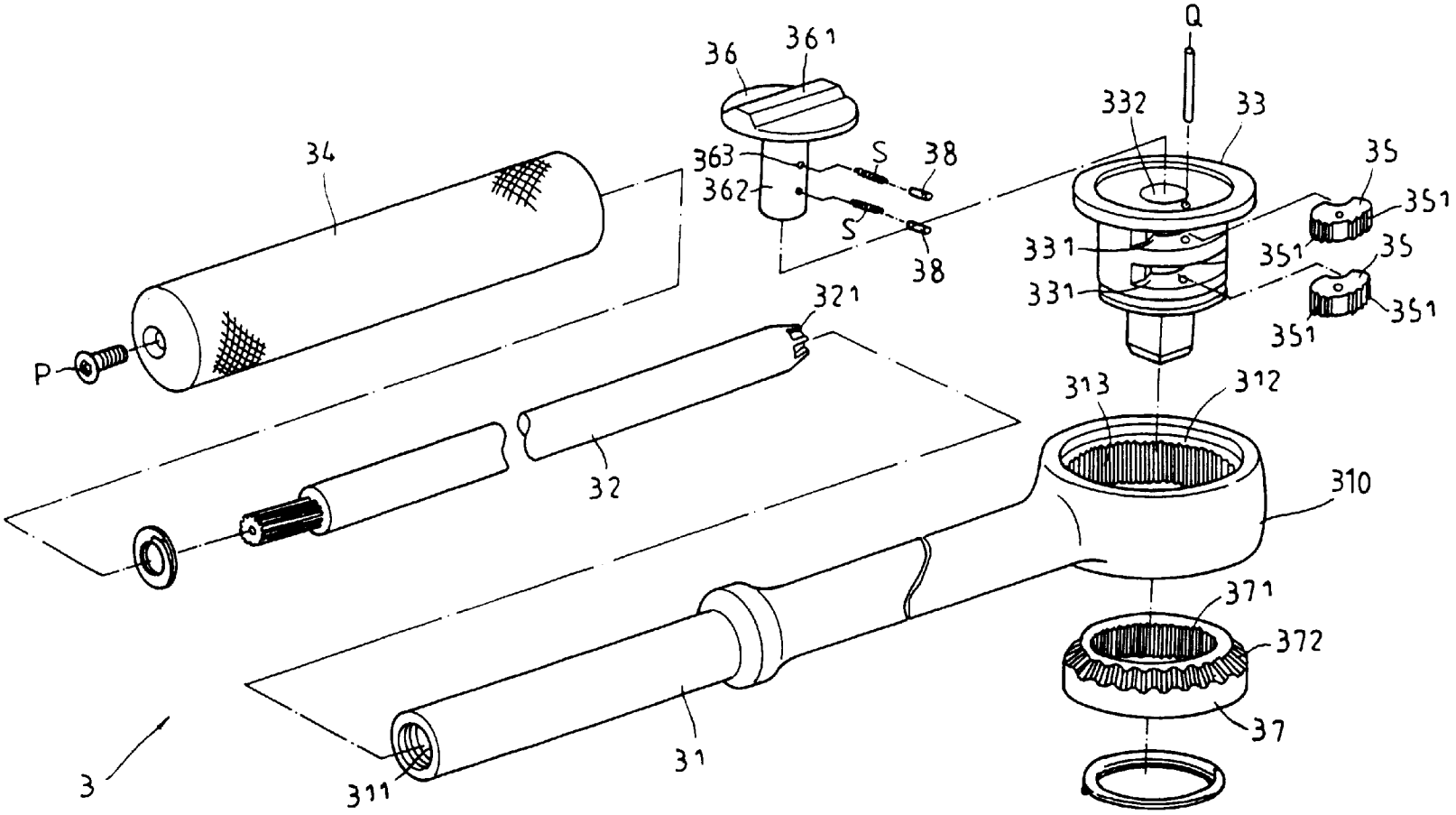
FIG. 4 PRIOR ART
FIG. 4 is a perspective exploded view of a ratchet wrench of another prior art.
Figure 5:
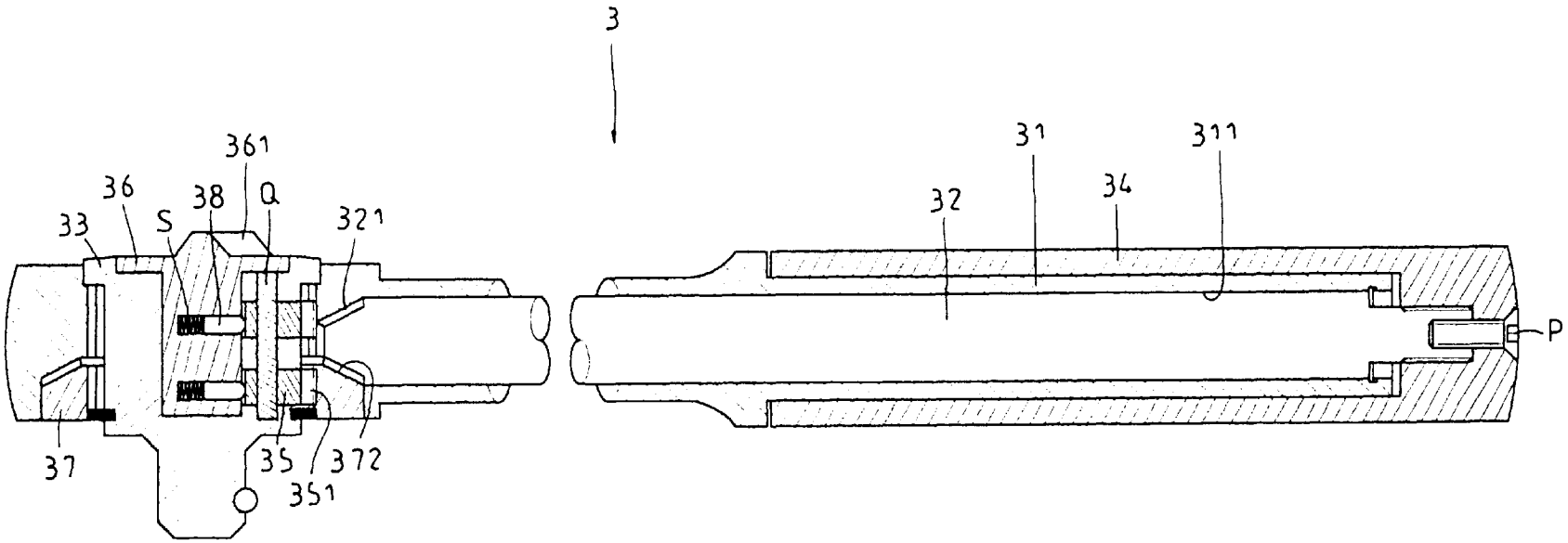
FIG. 5 PRIOR ART
FIG. 5 is a sectional assembly view of a ratchet wrench of another prior art.
Figure 6:
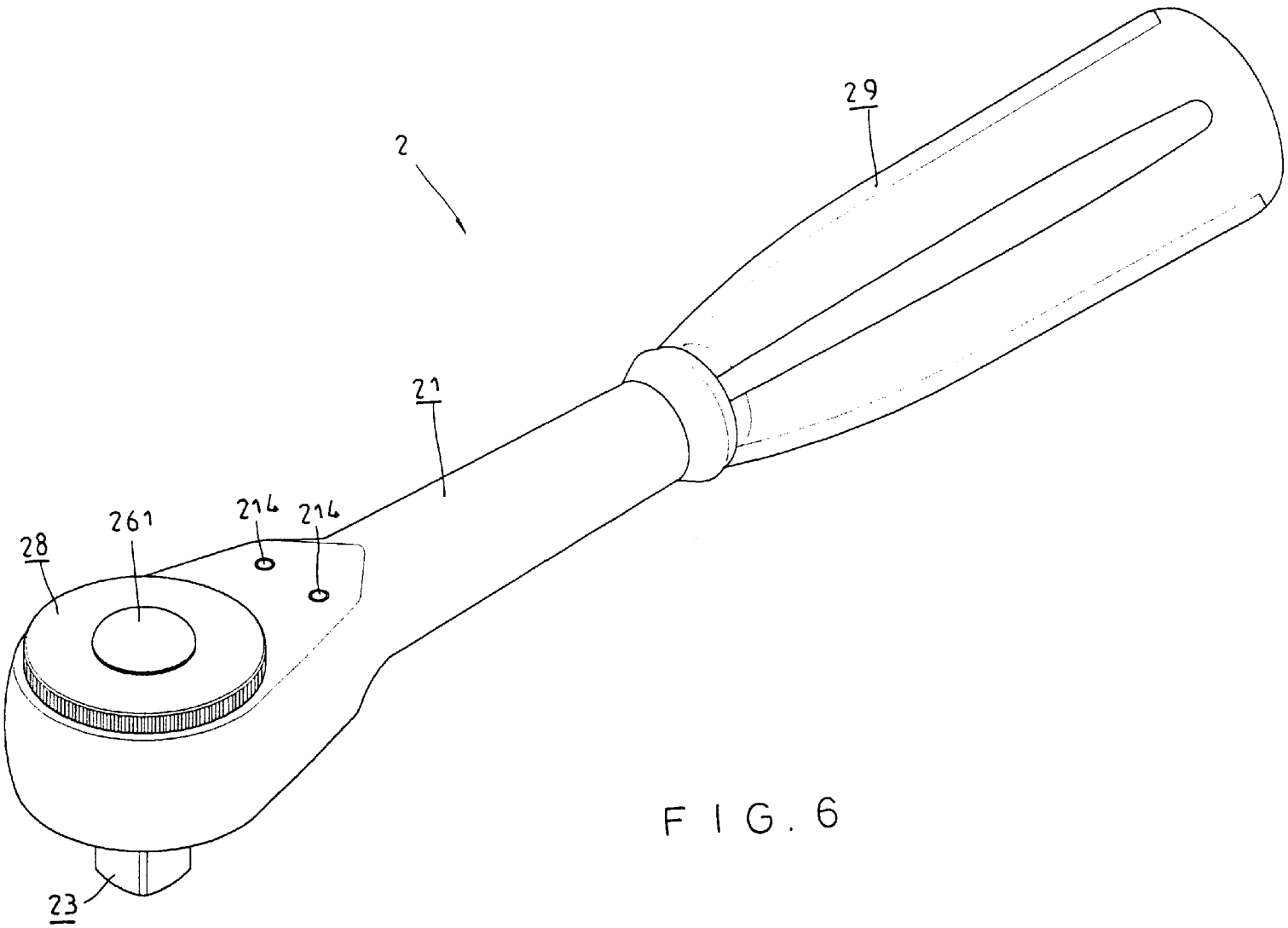
FIG. 6 is a perspective assembly view of a ratchet wrench of a preferred embodiment in accordance with the present invention.
Figure 7:
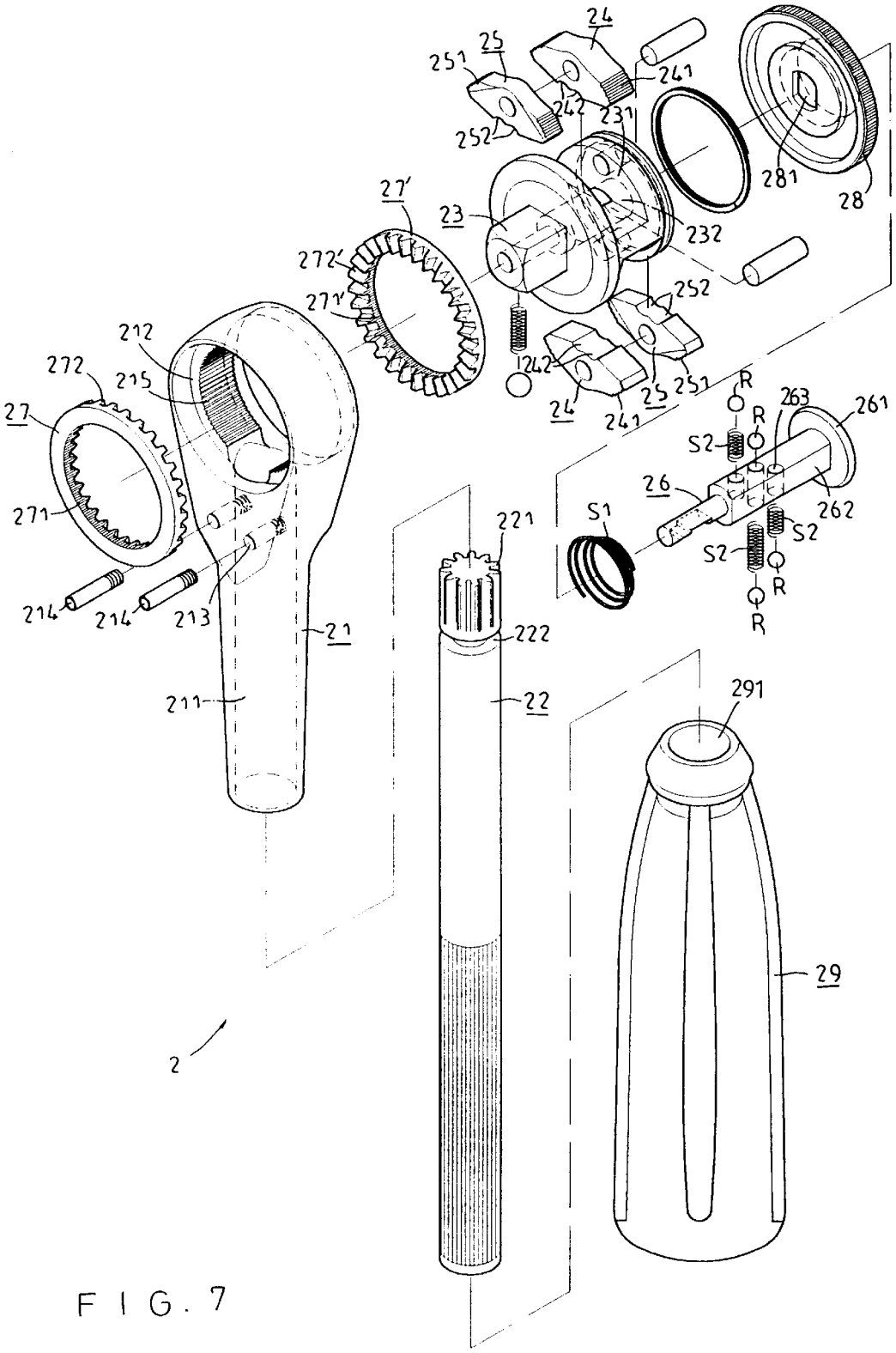
FIG. 7 is a perspective exploded view of a ratchet wrench of a preferred embodiment in accordance with the present invention.
Figure 9:
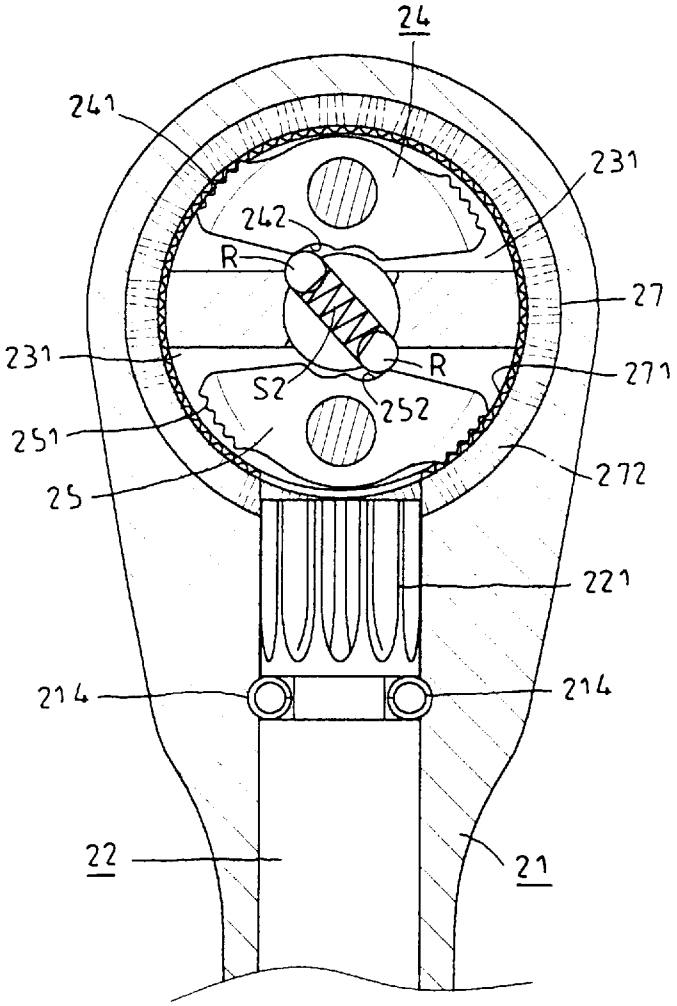
FIG. 9 is a sectional schematic view illustrating a second operation of a ratchet wrench of a preferred embodiment in accordance with the present invention.
Figure 8:
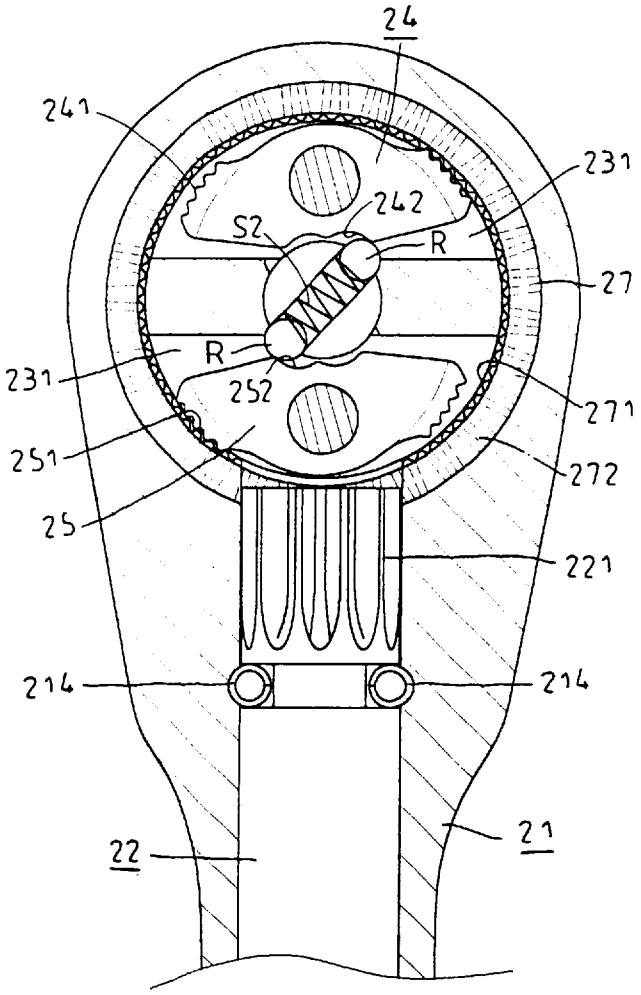
FIG. 8 is a sectional schematic view illustrating a first operation of a ratchet wrench of a preferred embodiment in accordance with the present invention.
Figure 10:
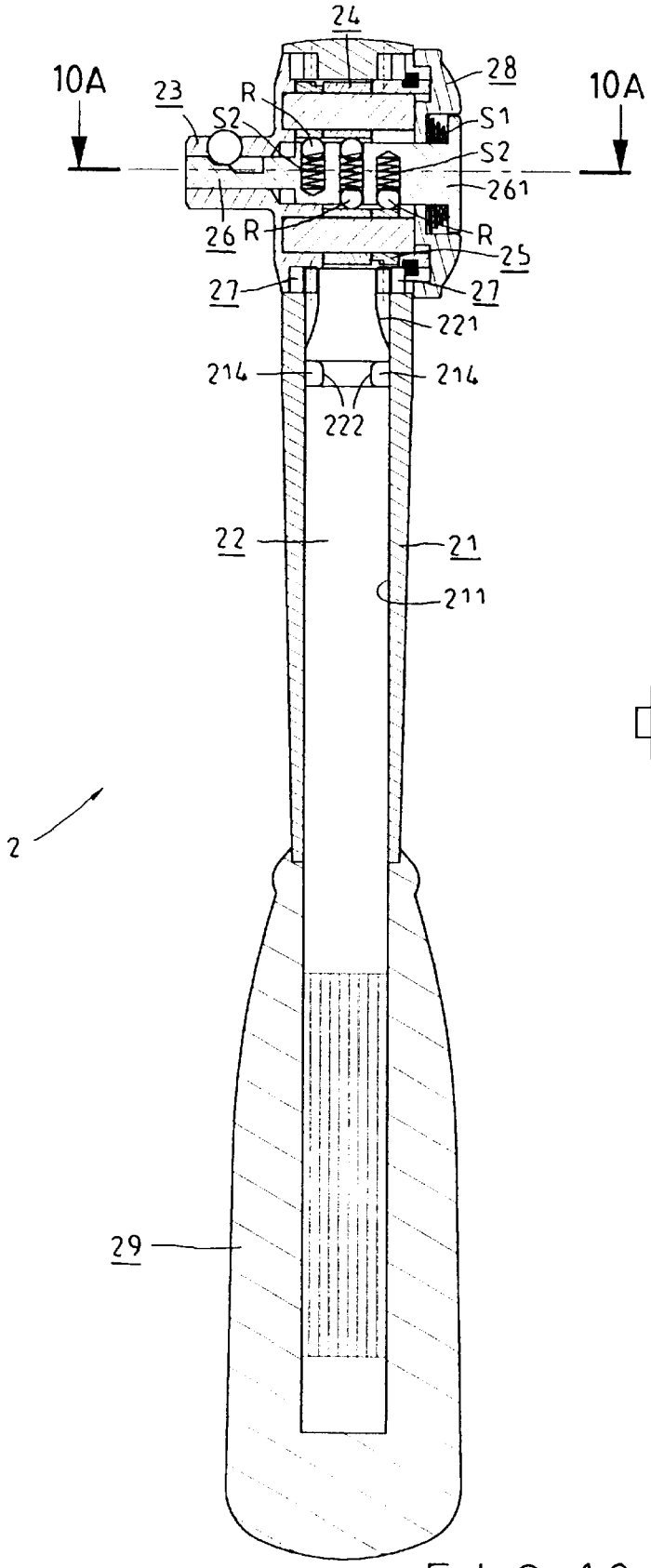
FIG. 10 is a sectional assembly view of a ratchet wrench of a preferred embodiment in accordance with the present invention.
Figure 10A:
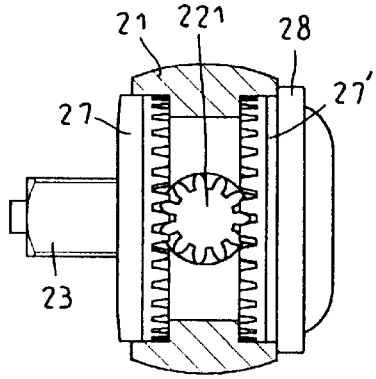
FIG. 10A is a sectional view taken along line 10A—10A in FIG. 10.

Referring to FIGS. 6 to 10A, a ratchet wrench 2 comprises a main body 21, a drive shaft 22, a handle 29, a first annular gear 27, a second annular gear 27', a drive member 23, a pair of first pawls 24, a pair of second pawls 25, a rotating wheel 28, a control member 26, a plurality of balls R, a plurality of compression springs S2, and a coiled spring S1.

The main body 21 has a through hole 211 to receive the drive shaft 22, a pair of pivot holes 213, a groove 212 to receive the drive member 23, a plurality of inner teeth 215, and the through hole 211 communicating with the groove 212.

The drive shaft 22 has a beveled gear 221 and an annular recess 222 formed between the beveled gear 221 and the drive shaft 22.

The drive member 23 has a through aperture 232 and a chamber 231.

The handle 29 has a blind hole 29 to receive the drive shaft 22.

The first annular gear 27 has a plurality of inner periphery serrations 271 and a plurality of one-sided serrations 272.

The second annular gear 27' has a plurality of inner periphery teeth 271' and a plurality of one-sided teeth 272'.

Each of the first pawls 24 has a plurality of positioning recesses 242 and a plurality of outer teeth 241.

Each of the second pawls 25 has a plurality of periphery serrations 252 and a plurality of one-sided serrations 251.

The rotating wheel 28 has an oblong center hole 281.

The control member 26 has a pillar 262 and a press disk 261 disposed on the pillar 262.

The pillar 262 has a plurality of circular holes 263.

Each of the circular holes 263 of the pillar 262 receives the corresponding compression spring S2 and the corresponding ball R.

A pair of studs 214 pass through the pivot holes 213 of the main body 21 and the annular recess 222 of the drive shaft 22.

The chamber 231 of the drive member 23 receives the first pawls 24 and the second pawls 25.

The first annular gear 27 encloses one of the first pawls 24 and one of the second pawls 25.

The second annular gear 27' encloses the other of the first pawls 24 and the other of the second pawls 25.

The bevel gear 221 engages with the one-sided serrations 272 of the first annular gear 27 and the one-sided teeth 272' of the second annular gear 27'.

The pillar 262 is inserted through the coiled spring S1, the oblong center hole 281 of the rotating wheel 28, and the through aperture 232 of the drive member 23.

The coiled spring S1 is disposed between the press disk 261 and the rotating wheel 28.

Each of the balls R engages with one of the first pawls 24 and the second pawls 25.

A diameter of the beveled gear 221 is the same as a diameter of the drive shaft 22.

When the rotating wheel 28 is rotated, the first pawls 24 and the second pawls 25 are deflected.

When the first annular gear 27 drives the drive member 23 to rotate, the second annular gear 27' rotates idly.

When the second annular gear 27' drives the drive member 23 to rotate, the first annular gear 27 rotates idly.

It is easy to pass the studs 214 through the pivot holes 213 of the main body 21 and the annular recess 222 of the drive shaft 22 in order to assemble the ratchet wrench.

The invention is not limited to the above embodiment but various modification thereof may be made. Further, various changes in form and detail may be made without departing from the scope of the invention.

I claim:

1. A ratchet wrench comprising:

a main body, a drive shaft, a handle, a first annular gear, a second annular gear, a drive member, a pair of first pawls, a pair of second pawls, a rotating wheel, a control member, a plurality of balls, a plurality of compression springs, and a coiled spring, the main body having a through hole to receive the drive shaft, a pair of pivot holes, a groove to receive the drive member, a plurality of inner teeth, and the through hole communicating with the groove, the drive member having a through aperture and a chamber, the handle having a blind hole to receive the drive shaft, the first annular gear having a plurality of inner periphery serrations and a plurality of one-sided serrations, the second annular gear having a plurality of inner periphery teeth and a plurality of one-sided teeth, each of the first pawls having a plurality of positioning recesses and a plurality of outer teeth, each of the second pawls having a plurality of periphery serrations and a plurality of one-sided serrations, the rotating wheel having an oblong center hole, the control member having a pillar and a press disk disposed on the pillar, the pillar having a plurality of circular holes, each of the circular holes of the pillar receiving the corresponding compression spring and the corresponding ball, a pair of studs passing through the pivot holes of the main body and an annular recess of the drive shaft, the chamber of the drive member receiving the first pawls and the second pawls, the first annular gear enclosing one of the first pawls and one of the second pawls, the second annular gear enclosing the other of the first pawls and the other of the second pawls, the pillar inserted through the coiled spring, the oblong center hole of the rotating wheel, and the through aperture of the drive member, the coiled spring disposed between the press disk and the rotating wheel, and each of the balls engaging with one of the first pawls and the second pawls.

2. The ratchet wrench as claimed in claim 1, wherein the drive shaft has a beveled gear and the annular recess is formed between the beveled gear and the drive shaft, and a diameter of the beveled gear is the same as a diameter of the drive shaft.

* * * * *